US005445364A

United States Patent [19]

Tibbals, Jr.

[11] Patent Number: 5,445,364

[45] Date of Patent: Aug. 29, 1995

[54] LOAD COUNTERBALANCING COILED WIRE SPRING ASSEMBLY

[75] Inventor: Edward C. Tibbals, Jr., Jamestown, N.C.

[73] Assignee: William Calvin Johnston, High Point, N.C.

[21] Appl. No.: 281,062

[22] Filed: Jul. 6, 1994

[51] Int. Cl.[6] ..... E05F 5/00

[52] U.S. Cl. ..... 267/74; 267/157; 16/197; 49/445

[58] Field of Search ..... 267/73–74, 267/155, 135, 154, 157, 166, 167, 195, 196, 273, 275, 286; 16/197, 199, DIG.16, DIG. 36; 49/445, 446, 420

[56] References Cited

U.S. PATENT DOCUMENTS

| | | | |
|---|---|---|---|
| 2,425,659 | 8/1947 | Viehweger | 16/197 |
| 2,473,666 | 6/1949 | Viehweger | 16/197 |
| 2,780,457 | 2/1957 | Larson | 267/157 |
| 3,718,326 | 2/1973 | Ristau | 267/154 X |

FOREIGN PATENT DOCUMENTS

| | | | |
|---|---|---|---|
| 1064286 | 12/1953 | France | 16/197 |

*Primary Examiner*—Josie A. Ballato
*Attorney, Agent, or Firm*—McAulay Fisher Nissen Goldberg & Kiel

[57] ABSTRACT

A load counterbalancing coiled wire spring assembly adapted to provide predetermined nonuniform bending stress induced torsional load supporting force in response to load induced longitudinal spring wire displacement.

13 Claims, 4 Drawing Sheets

LOAD COUNTERBALANCING COILED WIRE SPRING ASSEMBLY

This invention relates to an improved construction for counterbalanced double hung windows and mare particularly to an improved coiled wire spring assembly adapted to provide progressively varying load counterbalancing forces by selective release of preloaded reactive torsion induced bending stresses in the coiled wire spring in response to load induced longitudinal coiled wire spring displacement.

BACKGROUND OF THE INVENTION

Coiled wire springs of both the compression and extension types have long been employed in the art for energy storage and for resisting or applying compressive or extension forces. In such types of springs the forces associated with longitudinal spring displacement essentially vary in a linear manner with attendant load displacement. In many instances however it is desirable to have the force associated with spring displacement vary in a predetermined nonlinear or nonuniform manner with attendant load displacement. An example of the latter is in the use of springs to help balance constant force loads. Mechanisms of various types have thus been long employed to position displaceable articles at selected locations intermediate terminal limiting positions thereof through the balance of constant force loads, such X-ray slide mechanisms and retractable article positioning. For example, counterbalance systems have long been employed in double hung window panels to maintain the selected positioning of a window panel at any location intermediate a fully open and fully closed position. One early example thereof was the use of pulley supported sash weights or the like. Counterbalance mechanisms of varying types in which a specific nonlinear spring rate assists in counterbalancing pivoting loads have also been used such as in automobile hood and truck lids, oven doors, and the like.

With respect to coiled wire springs however, and in a more fundamental aspect coiled wire compression and extension springs store energy within the spring metal during compression and extension by deflecting and straining the spring metal throughout the active length of the spring and provide a force that is normally proportional to the amount of longitudinal spring displacement. In other areas of coiled wire spring usage and particularly where space constraints and mass efficiency are not primary design considerations, coiled wire springs that are directly responsive to rotative displacement, i.e., spring biased hinges, mouse traps and the like, have been long employed. In many areas of compression and extension coiled wire spring usage it would be desirable to have the forces associated with longitudinal spring displacement vary in a predetermined nonlinear manner therewith and, that such nonlinear response characteristics could be of great utility in the counterbalancing of constant force loads.

SUMMARY OF THE INVENTION

This invention may be briefly described as an improved construction for coiled wire springs adapted, in its broader aspects, to provide a predetermined nonuniform force response to external load induced longitudinal spring wire displacement. In another broad aspect, the invention may be described as an improved construction for counterbalancing compression and extension coiled wire spring assemblies that provide substantially constant spring loading independent of the magnitude of longitudinal spring wire displacement in response to externally applied loads. In its broad aspects the subject invention also includes an improved construction for counterbalancing compression and extension coiled wire spring assemblies in which the counterbalancing forces associated with spring displacement under load are of a character to provide an essentially constant load force independent of the degree of longitudinal spring displacement. In a somewhat narrower aspect the invention includes an improved construction for preloadable compression and extension coiled wire spring assemblies that operate to selectively provide progressively varying bending stress created torsional forces in the spring wire in response to longitudinal spring displacement and, in greater particularity, to create supplemental axial force in opposition to the magnitude of an externally applied load. In another narrower aspect, the subject invention includes an improved construction for counterbalanced double hung windows to maintain the selected positioning of a window panel at any location intermediate the permitted fully open or fully closed positions thereof.

In a further narrow aspect of the invention, the subject invention includes an improved construction for compression and extension coiled wire springs that functions to rotationally displace an elongated or compressed coil spring in accord with magnitude of longitudinal displacement thereof to selectively provide bending stresses therein and to thus produce reactive axial forces that supplement to the torsional forces induced in said coiled wire spring by longitudinal displacement thereof. In still another narrow aspect there is provided an improved counterbalance mechanism for compression and extension coiled wire springs that provides supplemental selective bending stress induced reactive torsional forces therein without derogation of component alignment and with minimal frictional loss.

Among the advantages of the subject invention is the provision of an improved construction for compression and extension coiled wire spring systems that provides bending stress induced nonuniform reactive forces therein in response to load induced longitudinal spring displacement; the provision of a construction for compression and extension coil spring assemblies that readily provide for predetermined nonlinear, or nonuniform response characteristics in response to the magnitude of the applied load and the magnitude of longitudinal displacement induced thereby. Still another advantage of the subject invention is the provision of a markedly improved counterbalancing construction for coiled wire springs for use in double hung windows and other devices where it is desired to provide a constant force load response.

A primary object of the subject invention is the provision of an improved construction for nonuniform response coiled wire spring assemblies that provides progressively varying bending stress induced reactive forces that supplement the torsional forces created in the spring wire by load induced longitudinal spring displacement.

Another primary object of this invention is the provision of an improved counterbalancing construction for coiled wire spring assemblies to provide constant force load response.

Other objects and advantages of the subject invention will become apparent from the following portions of this specification and from the appended drawings which illustrate, in accord with the mandate of the patent statutes, the principles of this invention as embodied in a presently contemplated preferred construction for a counterbalanced double hung window and for a counterbalancing coiled wire spring assembly includable therein.

DETAILED DESCRIPTION OF THE INVENTION

Figure 1A:
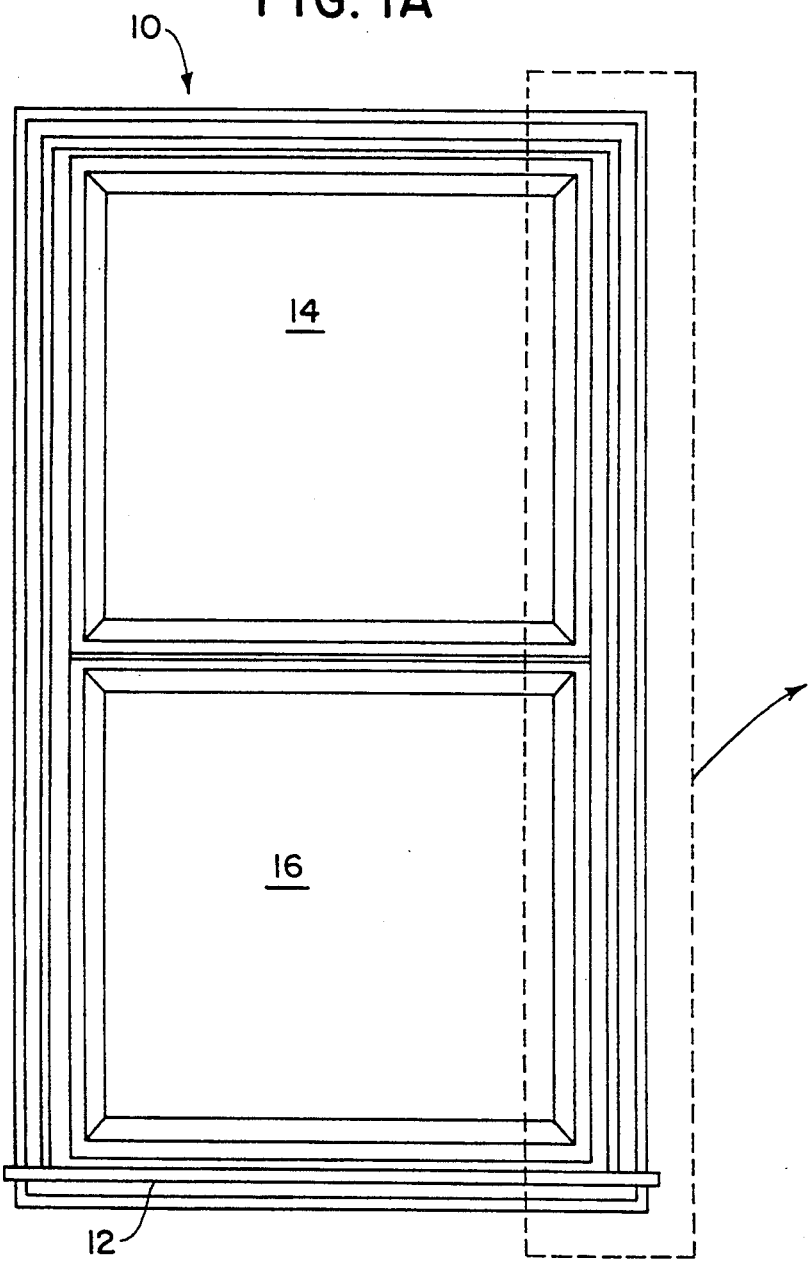
FIG. 1A is a schematic plan view of an improved double hung window construction incorporating the principles of this invention.
Figure 1B:
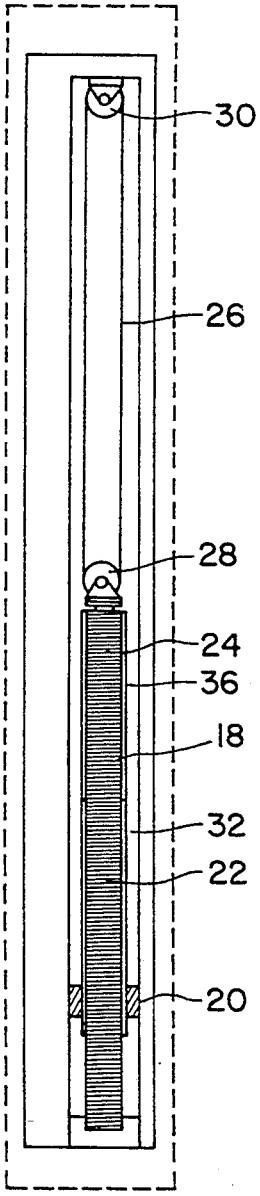
FIG. 1B is a side elevation, partially in section, of the portion of the window enclosed within the dotted line on FIG. 1A.

Referring to the drawings and initially to FIG. 1A there is depicted a double hung window panel assembly that includes a peripheral frame 10, a sill 12, an upper vertically displaceable window panel 14 and a lower vertically displaceable panel 16. By way of illustrative example, the upper panel 14 has an associated counterbalancing coiled wire spring assembly, generally designated 18, located within the frame 10 and constructed in accord with the principles of this invention. As schematically depicted in the dotted line enclosed extension, Figure 1B, such load counter-balancing assembly broadly includes a nonrotatable base member 20 having one end of a preloadable elongate coiled wire spring 22 secured thereto. The upper and displaceable end 24 of the coiled wire spring 22 is secured, through cord 26 and pulleys 28 and 30, to an external load, here comprising the upper window panel 14. Also mounted on the base 20 and extending upwardly therefrom in surrounding and uniformly spaced relation from the longitudinal axis of the coiled wire spring 18 is an upwardly open and nonrotatable outer sleeve member 32. The upper end 24 of the coiled wire spring 18 is conveniently secured to a load connector plug 82 in FIG. 2, having one end of an open ended sleeve 36 fixedly mounted therein and extending downwardly therefrom within the outer sleeve member 32.

As will later be explained in greater detail such preloadable coiled wire spring assembly includes means to effect a selective and concomitant rotative displacement of the inner sleeve 36 and the extendable end 24 of the coil 18 in predetermined relation with the magnitude of the load induced longitudinal displacement of said free extendable spring end 34 to selectively provide nonlinear reactive bending stress induced torsion al forces within the spring wire and an associated supplemental force of opposing the load induced longitudinal displacement of the coiled wire spring.

The improved coiled wire spring assembly modifies the rate and action of a standard helically wound extension or compression spring in such manner as to provide a nonlinear force-displacement curve. Such modification of spring response is effected by combining the two means of storing energy in coiled wire spring so as to generate a desired restoring force at each increment of load displacement. In the hereinafter described embodiment the rate and action of a standard helically wound coiled wire spring will be modified to produce a constant force over the entire length of a load induced linear displacement of the spring. More specifically as a coiled wire spring is stretched under a load, the restoring force increases proportionally with spring extension because the active coils in the spring are torsionally deflected and strained proportionally to the distance that the spring is deflected. In order to provide a constant force response an additional tension force must be created as the spring first starts to elongate and this "make up" force proproportionately reduced to zero as the spring reaches maximum deflection under load.

Figure 2:
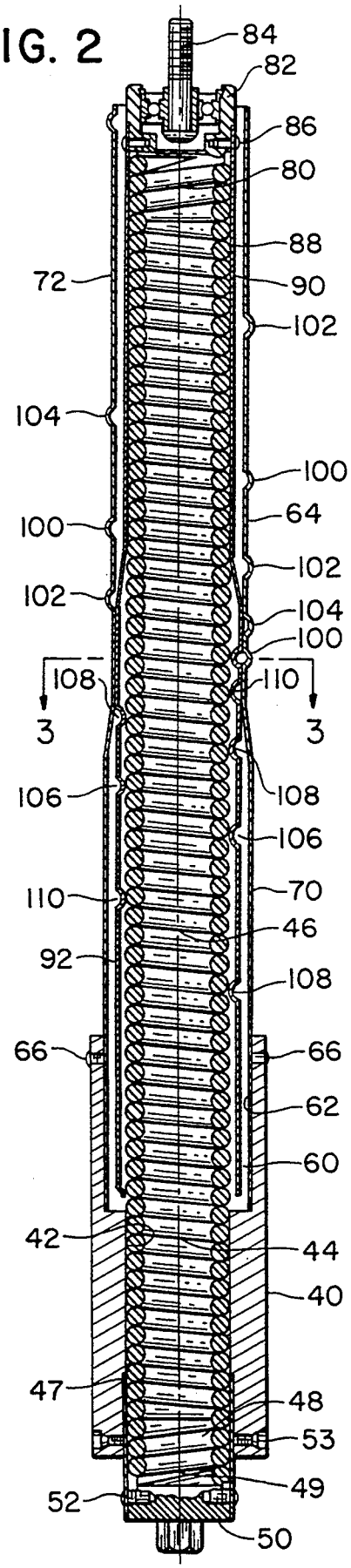
FIG. 2 is a sectional view of a coiled wire spring assembly incorporating the principles of this invention.

Referring now to FIG. 2, a presently preferred construction for a constant force load counterbalancing coiled wire spring assembly incorporating an elongate standard helically wound extension spring, includes a nonrotatable base member 40 of suitable external shape as to permit mounting thereof on a foundation component at the locus of use. The base member 40 contains a first bore 42 sized to contain the lower end portion 44 of an elongate standard helically wound coiled wire extension spring 46. The end portion 48 of the spring 46 is disposed within a displaceable preloading sleeve 47 and the last few coils thereof are attached to the threaded shaft 49 of a plug member 50. The plug member 50 is rotatably mounted at the end of the preloading sleeve 47 and securable therein by locking screws 52. The preloading sleeve 47 is longitudinally and rotationally displaceable within the bore 42 and securable therewithin in fixed position by locking screws 53. As will be apparent, the permitted longitudinal displacement of the preloading sleeve 47 and rotative displacement of the plug 50 permits both longitudinal and rotative preloading of the coiled wire spring 46.

Once the preloading sleeve 47 and plug 50 have been positioned and secured by the locking screws 52 and 53 to provide a desired level of preloading, both longitudinal and/or rotationally, the lower end of the coiled wire spring 46 will be fixedly positioned relative to the base member 40. The bore 42 communicates with an adjacent coaxial second and larger diameter bore 60 sized to contain the lower end 62 of an elongate open ended tubular sleeve member 64 that is of a length that extends over the full length of the coiled wire spring 46. The lower end 62 of the sleeve member 64 is appropriately secured to the base member 40 by a plurality of screws 66 in such manner as to preclude both rotative and longitudinal displacement of the sleeve member 64 relative to the base member 40 and to the elongate coiled wire spring 46. As illustrated, the sleeve member 64 is disposed in longitudinal coaxial and space relation with the longitudinal axis 62 of the coiled wire spring 46. The lower portion 70 of the sleeve member 64 is of somewhat greater diameter than the upper portion 72 thereof with both diameters being sufficient to dispose the sleeve in spaced relation with the outer surface of the coiled wire spring 46.

The upper or extendable terminal end 80 of the coiled wire spring 46 is rigidly secured to a connector plug 82 that contains a ball bearing mounted connecting rod 84 extending from the hub thereof for connection with the external load to be applied to the spring. The described interconnection between the spring end 80, the ply 82 and connecting rod 84 permits conjoint longitudinal displacement of the rod, spring and plug, and conjoint rotative displacement of the plug and spring independent of the connecting rod 84. Rigidly secured to the connector plug 82, as by screws 86, is the upper end of an open ended second elongate sleeve member 88. Such interconnection with the plug 82 renders the second sleeve member 88 both longitudinally and rotatably displaceable in conjunction therewith. The second sleeve member 88 is disposed intermediate the first sleeve member 64 and the outer surface of the coiled wire spring 46 and is of a length that extends into the bore 60 in the base member 40 when the coiled wire spring 46 is in unextended condition. The second sleeve member 88 has an upper portion 90 of an internal diameter that slightly exceeds the diameter of the coil spring 68 and a lower portion 92 of increased internal diameter so as to position such lower portion in spaced relation with both the coil spring 86 and the outer sleeve member 64.

As previously pointed out, constant force load counterbalancing is effected by controlled rotation of the displaceable end 80 of the preloaded coiled wire spring 86 in response to external load induced longitudinal displacement thereof to create a reactive bending stress induced torsional forces in the spring wire. As pointed out above, such longitudinal load induced displacement of the displaceable end 80 of the coiled wire spring 46 is accompanied by an equal longitudinal displacement of the second sleeve member 88 relative to the first and fixedly positioned outer sleeve member 64. Means are included in the sleeve members 64 and 88 to translate such longitudinal displacement of the second sleeve member 88 relative to the first sleeve member 64 into selective rotational displacement of the second sleeve member 88 and the displaceable end 80 of the coiled wire spring to provide bending stress induced nonlinear and nonuniform reactive torsional forces in the coiled wire spring to supplement the restoring torsional shear stress forces therein resulting from linear load displacement in amounts sufficient to provide an effectively constant total restoring force equal to the load at all increments of longitudinal spring displacement.

Figure 3:
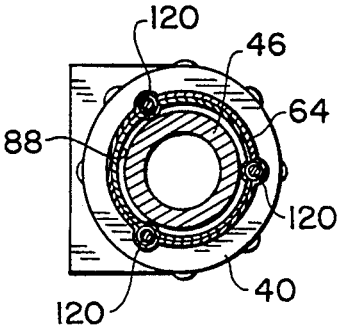
FIG. 3 is a section as taken on the line 3—3 of FIG. 2.

Referring again to FIGS. 2 and 3 and also to FIG. 4 such translating means includes a plurality, suitably three, of inwardly facing, equiangularly spaced helical tracks or channels 100, 102 and 104 in the fixed outer sleeve member 64. The tracks or channels 100, 102 and 104 are nonuniform pitch helixes with progressively increasing helix angles. Operatively associated therewith are an equal numbers of outwardly facing equiangularly spaced nonuniform helical tracks or channels 106, 108 and 110 in the movable inner sleeve member 88. The tracks or channels 106, 108 and 110 are also nonuniform pitch helixes with progressively increasing helix angles.

Operatively interconnecting each such set of tracks and continually positioned at the track crossing points are hardened steel balls 120. The balls 120 permit conjoint rotational and longitudinal displacement of the sleeve 88 relative to the sleeve 64 and further function to transmit the axial component of the bending stress induced torsional forces in the spring member 46 to the connector plug 82. These recessed ball tracks effectively spiral around the circumference of each sleeve member so that as the inner sleeve member 88 is longitudinally displaced in accord with longitudinal spring extension relative to the outer sleeve member 64, the inner sleeve member 88 is also rotatably and differentially displaced by the rolling balls 120 relative to the outer sleeve member 64. Such rotationable displacement of the inner sleeve member 88 effects a concomitant rotative displacement of the coiled wire spring 46 to provide bending stress induced torsional forces that supplement the torsional shear stress forces created in the spring induced by longitudinal displacement thereof. As noted above the balls 120 also function to transmit the axial component of such torsional shear stress forces to connector plug 82. As will be now apparent, if the spring 46 is rotationally preloaded, the subsequent rotational displacement of the spring 46 will function to reduce the forces generated by such preloading and will thus progressively reduce the bending stress induced torsional forces in conjunction with the increases in extension.

Figure 4A:
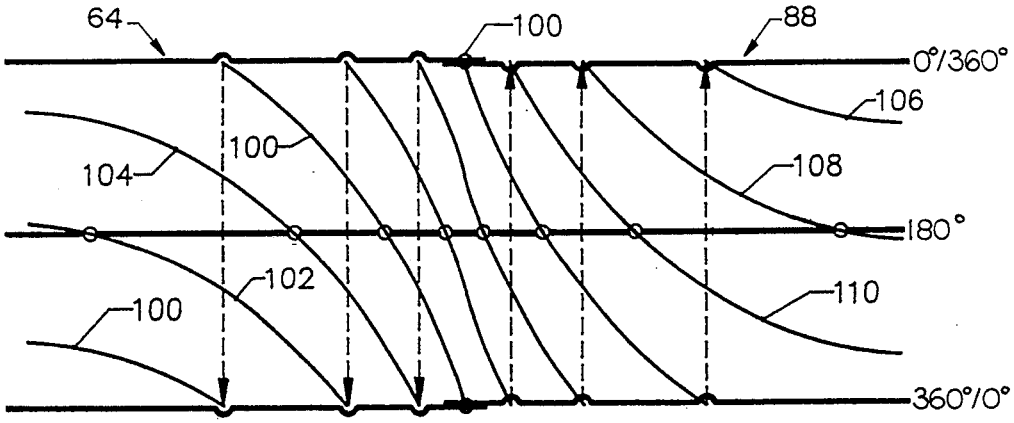
FIG. 4A is a schematic flattened or planar projection of the cylindrical surfaces of the sleeve members showing the location and general configuration of the translating channels therein.
Figure 4B:
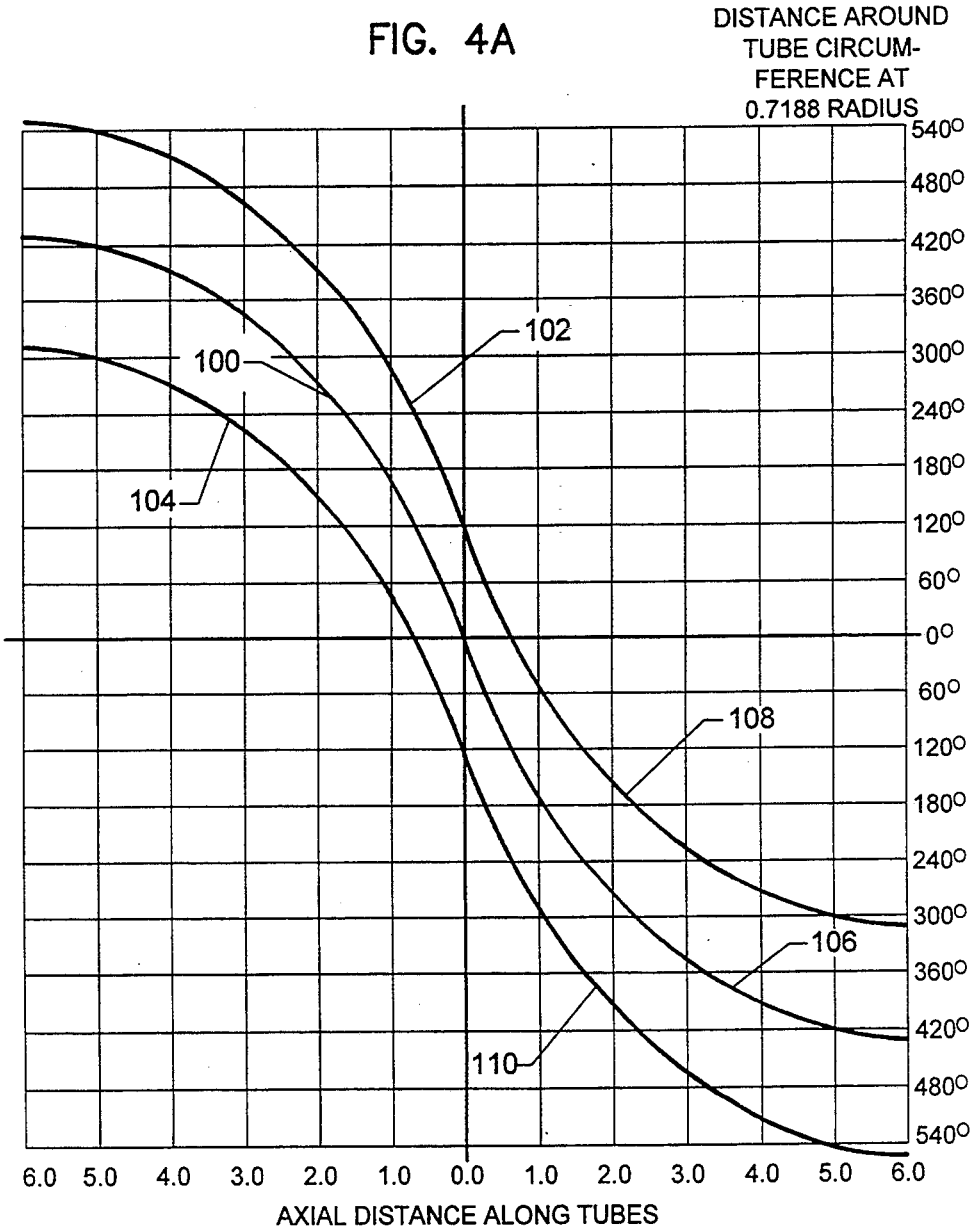
FIG. 4B is a graphical presentation showing the configuration of the channels in the translating sleeves as a function of length and angular position.

By way of example FIG. 4A shows as a flattened 360° projection of the cylindrical sleeve surfaces, the positioning of the nonlinear helical channels 100, 102 and 104 in the stationary sleeve member 64 in association, in unextended spring position, with the nonlinear helical channels 106, 108 and 110 in the movable sleeve member 88. FIG. 4B graphically depicts the axial track or channel locations for each sleeve member in relation to the angular position on the sleeve circumferences. As can readily be seen thereon the channels or tracks start out at the 0 distance location with a low helix angle to provide a high initial leverage, a high rate of rotative displacement for the movable sleeve member 88 and a high axial vector force. The helix angle progressively decreases with a concomitant decrease in unit rotative displacement of sleeve member 88 and reduction in the axial vector force as the longitudinal displacement of the sleeve member 88 continues and eventually ends up being essentially parallel to the longitudinal axis of the coiled wire spring 46. The instantaneous helix angle along the ball track is determined by equating the bending stress induced torsional force in the preloaded spring with the axial make up force required to be added to the torsional extension induced force to produce a constant total force in the mechanism at all increments of load induced deflection. The shape of the illustrated channel curves is determined by a series of incremental calculations which modify the local instantaneous helix angle so as to keep the total of the force generated by spring displacement and the bending stress induced torsional force a constant amount throughout the full extent of load induced elongation or compression.

Figure 5A:
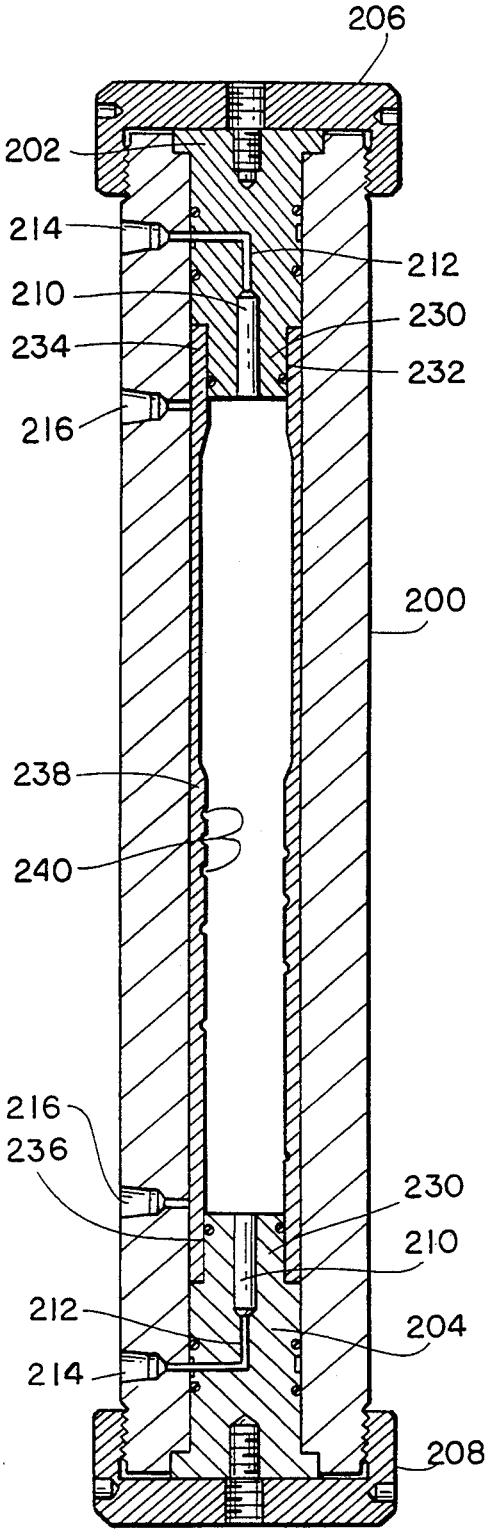
FIG. 5A is a sectional view of a presently preferred apparatus for forming the nonlinear helical tracks or channels in the stationary sleeve member.
Figure 5B:
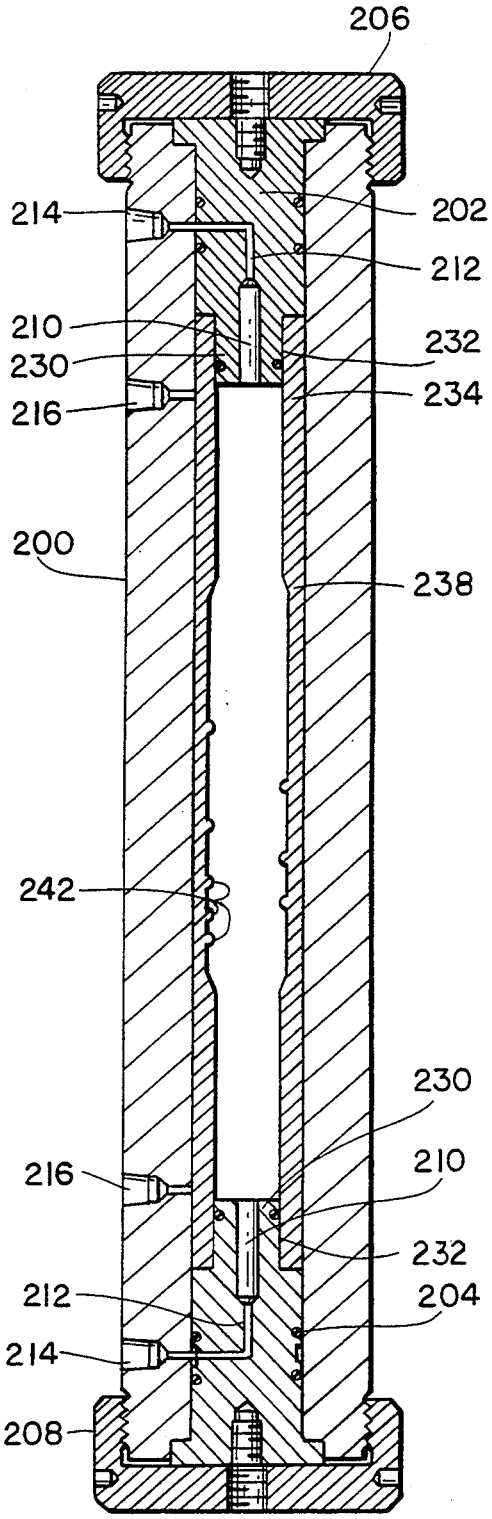
FIG. 5B is a sectional view of a presently preferred apparatus for forming the nonlinear helical tracks or channels in the movable sleeve member.

A further feature of the subject invention is the provision of an improved method and apparatus of forming the translating track or channels in the sleeve member 64 and 88. FIGS. 5A and 5B illustrate suitable apparatus for forming the channeled sleeves in accord with the hereinafter described method. Such apparatus is essentially identical except for the configuration of the die shoes and hence the same reference numerals will be employed for the similar components in both Figures. Included therein is a cylindrical pressure housing 200 closed at the upper and lower ends by end plugs 202 and 204. Disposed in overlying relation with the end plugs are upper and lower end caps 206 and 208. Each of the end plugs includes an axial channel 210 connected through an internal right angled channel 212 to an aligned vent for pressurizing port 214 in the wall of the pressure housing 200. Also included in the wall of each of the pressure housing 200 are a pair of expansion relief ports 216.

Each of the end plugs 202 and 204 is provided with a reduced diameter shank 230 at the terminal end thereof that provides, with the adjacent inside wall of the pressure housing 200 a cylindrical recess 232 sized to closely contain the upper and lower ends 234 and 236 of a cylindrical die shoe 238. The die shoe 238 is formed of three 120° segments whose internal surfaces are selectively contoured to provide channel or track forming surfaces of the nonuniform helix configurations as described above. As depicted the die shoe 238 in FIG. 5A includes channel forming semicircular recesses 240 to provide a sleeve member with internally facing recesses deferring the channels or tracks that are included in the outer fixed sleeve member 64. Secularly the die shoe 238 depicted in FIG. 5B includes inwardly directed protrusions 242 to provide a sleeve member with outwardly facing recesses that will define the channels or tracks that are included in the movable sleeve 88.

In the fabrication of such sleeves a thin walled seamless tube, of a diameter to be closely contained within the minimal internal diameter end portions of the die shoe assembly is placed in the die cavity and terminally secured therein by upper and lower end plugs 202 and 204. After mounting of the end caps 206 and 208 hydraulic fluid is introduced into the cavity and raised to a high pressure, suitably in the order of 35K psi. Such hydraulic pressure will force an outwardly directed displacement of the tube into close interfacial engagement with the surface of the die shoe to form sleeves of the request shape and having the desired nonuniform helical tracks or channels therein.

An alternative forming method involves the mounting of a nichrome wire on the longitudinal axis of the die cavity, suitable connections and insulation being included in the end plugs and end caps thereof, the filling of the die cavity with water and then discharging a capacitor bank or other derived high voltage therethrough of a magnitude sufficient to vaporize the nichrome wire and the surrounding water to effect an externally rapid pressure rise therewithin to effect rapid super-plastic deformation of the seamless tube into conformity with the die shoe surface.

As will now apparent to those skilled in this art the subject invention broadly provides method and apparatus for selective modification of the response characteristics of coiled wire springs. While such response characteristic modification will perhaps find its greatest utility in the presence of a constant force response to applied load in general accord with the above disclosed and described embodiment application of the principles of this invention equally permit the selective modification of the response characteristics of coiled wire springs in many different manners.

Having thus described my invention, I claim:

1. A load counterbalancing coiled wire spring assembly comprising:

a nonrotatable base member, a coiled wire spring having a first end secured to said nonrotatable base member and a second endremote therefrom displaceable longitudinally of the coiled wire spring axis through a predetermined distance intermediate a fully retracted and fully extended position in response to the magnitude of an external load applied thereto, said load induced longitudinal displacement of said second end creating shear stresses in the coiled wire spring of progressively increasing magnitude proportional to the degree of longitudinal displacement of said second end intermediate said fully extended and fully retracted positions thereof, a first nonrotatable sleeve member connected to said base member and disposed in surrounding coaxial spaced relation with said coiled wire spring, a second sleeve member disposed intermediate said coiled wire spring and said first sleeve member and secured to second end of said coiled wire spring to render said second sleeve member longitudinally and rotatably displaceable in conjunction therewith, displacement means responsive to the magnitude of external load-induced longitudinal displacement of said second end of said coiled wire spring and said second sleeve member secured thereto for rotatably displacing said second end of said coiled wire spring to selectively provide reactive torsional bending stresses in said coiled wire spring of a magnitude sufficient to maintain said external load in any selected equilibrium position intermediate said fully retracted and fully extended positions thereof.

2. A load counterbalancing coiled wire spring assembly as set forth in claim 1 wherein said coiled wire spring is preloaded with bending stress induced torsional force prior to load induced extension thereof.

3. A load counterbalancing coiled wire spring assembly as set forth in claim 2 wherein said rotation of said coiled wire spring operates to progressively modify the bending stress induced torsional force therein.

4. A load counterbalancing coiled wire spring assembly as set forth in claim 1 including means for maintaining said first and second sleeve members in uniform spaced transverse relation with each other and with the longitudinal axis of said coiled wire spring.

5. A load counterbalancing coiled wire spring assembly as set forth in claim 1 wherein said second end of said coiled wire spring is progressively rotatably displaced in accord with increased degrees of load induced longitudinal displacement thereof to progressively modify said reactive bending stress torsion force in said coiled wire spring to magnitudes that progressively supplement the longitudinal displacement created shear stresses therein to maintain said external load applied to said second end at any selected equilibrium location intermediate the fully extended and fully retracted positions thereof.

6. A load counterbalancing coiled wire spring assembly as set forth in claim 5 in combination with a double hung window having upper and lower vertically displaceable window panels and wherein one of said window panels comprises the external load.

7. A load counterbalancing coiled wire spring assembly as set forth in claim 1 further including means for bending stress preloading said coiled wire spring prior to external load attachment thereto.

8. A load counterbalancing coiled wire spring assembly as set forth in claim 7 wherein said preloading means comprises means for rotatably displacing said coiled wire spring relative to said base member prior to external load attachment thereto to introduce said bending stress therein.

9. A load counterbalancing coiled wire spring assembly as set forth in claim 1 wherein said displacement means for rotatably displacing said second end of said coiled wire spring comprises first nonuniform pitch helical track means disposed on an intersleeve facing surface of at least one of said sleeve members, interlock means disposed in engagement with the intersleeve facing surface of the other of said sleeve members and positioned in operative engagement with said nonuniform helical pitch track means for effecting selective rotational displacement of said second sleeve member and said coiled wire spring relative to said first sleeve member in response to the magnitude of longitudinal displacement of said second sleeve member relative to said first sleeve member induced by said external load application thereto to introduce predetermined amounts of reactive bending stress in said coiled wire spring to maintain said external load in equilibrium at any selected position intermediate said fully retracted and fully extended position thereof.

10. A load counterbalancing coiled wire spring assembly as set forth in claim 1, wherein said displacement means for rotatably displacing said second end of said coiled wire spring comprises first nonuniform pitch helical track means disposed on the inner surface of said first sleeve member, second and complementally shaped nonuniform pitch helical track means disposed on the outer surface of said second sleeve member, rolling ball interlock means mutually engaging said first and second helical track means for effecting selective rotational displacement of said second sleeve member in response to the magnitude of longitudinal displacement of said second sleeve member relative to said first sleeve member induced by said external load application thereto to introduce predetermined amounts of reactive bending stress into said coiled wire spring to maintain said external load in equilibrium at any selected position intermediate said fully retracted and fully extended positions thereof.

11. A load counterbalancing coil spring assembly as set forth in claim 10 wherein said first nonuniform helical track means comprises a plurality of discrete and circumferentally uniformly spaced inwardly facing recessed channels said second nonuniform helical track means comprises an equal number of discrete and circumferentally uniformly spaced outwardly facing recessed channels, and said rolling interlock means comprises a substantially nondeformable member disposed in each of said recessed channels at the locus of overlying facing relationships therebetween.

12. A load counterbalancing coiled wire spring assembly as set forth in claim 1 in combination with a double hung window having upper and lower vertically displaceable window panels and wherein one of said window panels comprise the external load.

13. A method of modifying the response characteristic of a coiled wire spring that is longitudinally displaceable under applied load comprising the steps of fixedly locating one end of said coiled wire spring, preloading said coiled wire spring with bending stress induced force having an axial component of a magnitude approximately that of the load to be applied to the free end of said spring, rotatably displacing the free end of said coiled wire spring concurrent with load induced displacement thereof to progressively reduce the magnitude of said preloaded bending stress induced torsional force concurrent with the increase in torsional shear stress created by load induced longitudinal displacement of said coiled wire spring so as to provide a composite restoring force substantially equal to said load at all spring positions intermediate the fully retracted and fully extended positions thereof.

* * * * *